United States Patent [19]

Voss et al.

[11] Patent Number: 4,530,472

[45] Date of Patent: Jul. 23, 1985

[54] WIRE MARKER DISPENSER

[75] Inventors: Roy N. Voss, Fairdale; Marvin J. Peplow, Sycamore, both of Ill.

[73] Assignee: Ideal Industries, Inc., Sycamore, Ill.

[21] Appl. No.: 623,093

[22] Filed: Jun. 21, 1984

[51] Int. Cl.[3] ..... B65H 19/04; B65H 49/18

[52] U.S. Cl. ..... 242/55.3; 242/137.1; 225/34

[58] Field of Search ..... 242/130.3, 130.4, 132, 242/134, 136, 137, 137.1, 141, 146, 55.3; 206/391-393, 409, 411; 225/46, 47, 57, 77, 34; 226/196, 197

[56] References Cited

U.S. PATENT DOCUMENTS

| | | | |
|---|---|---|---|
| 1,965,404 | 7/1934 | Biele | 242/55.3 |
| 2,663,369 | 12/1953 | Erhardt | 225/77 X |
| 2,711,357 | 6/1955 | Nelson et al. | 242/55.3 X |
| 2,961,736 | 11/1960 | Kier | 225/34 X |
| 2,974,839 | 3/1961 | Batlas et al. | 225/12 |
| 3,342,952 | 9/1967 | Meyer | 226/196 |
| 3,870,211 | 3/1975 | Schriever | 225/34 |
| 4,009,845 | 3/1977 | Santucci et al. | 242/129.7 |
| 4,195,794 | 4/1980 | Ricci et al. | 242/96 |
| 4,410,084 | 10/1983 | Ladner | 206/409 X |
| 4,459,165 | 7/1984 | Meis et al. | 206/411 X |

*Primary Examiner*—Leonard D. Christian

*Attorney, Agent, or Firm*—Kinzer, Plyer, Dorn & McEachran

[57] ABSTRACT

This is a dispensing device or packet or container for dispensing tape for marking wire and is directed to a dispenser which will hold a large number of tape spools in a given volume and is easy to use and may be readily carried by the user. It has a cover with an open interior with a plurality of side openings with mountings and offset guides corresponding to the openings in the sides with the cover being hinged to a housing and a releasable latch therefor. It may be made in a two part housing with spools mounted in each half or a one part housing and a flat cover thereon. If it is made in a two part housing with spools in each half, there are openings in the side of the housing halves which are offset relative to each other.

10 Claims, 16 Drawing Figures

Fig. 1.
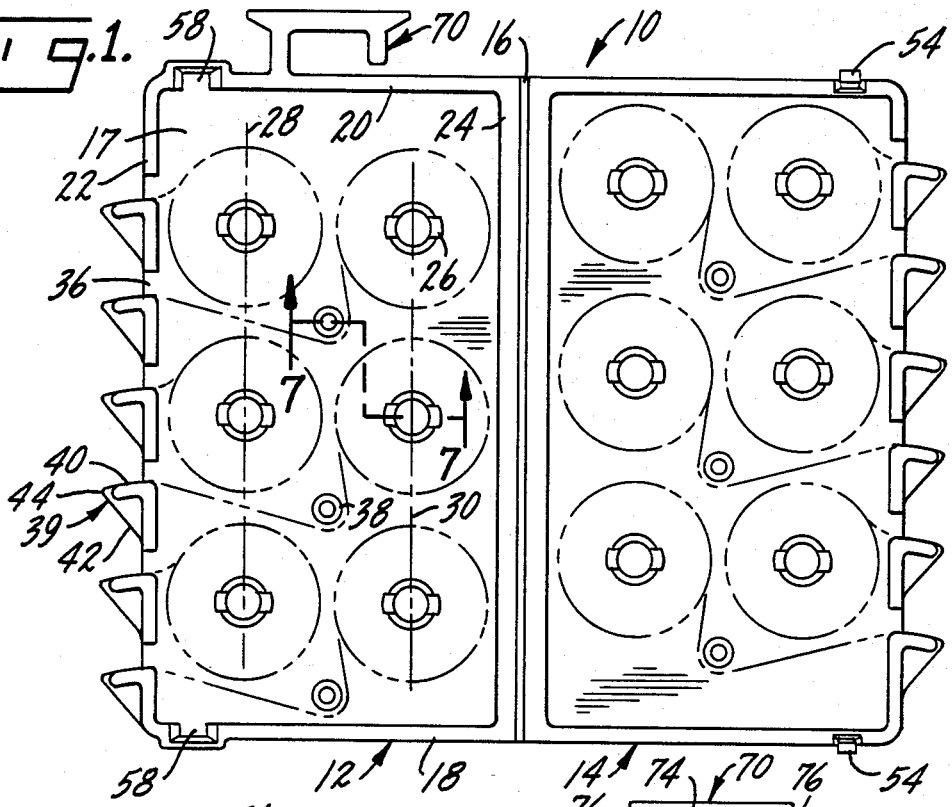
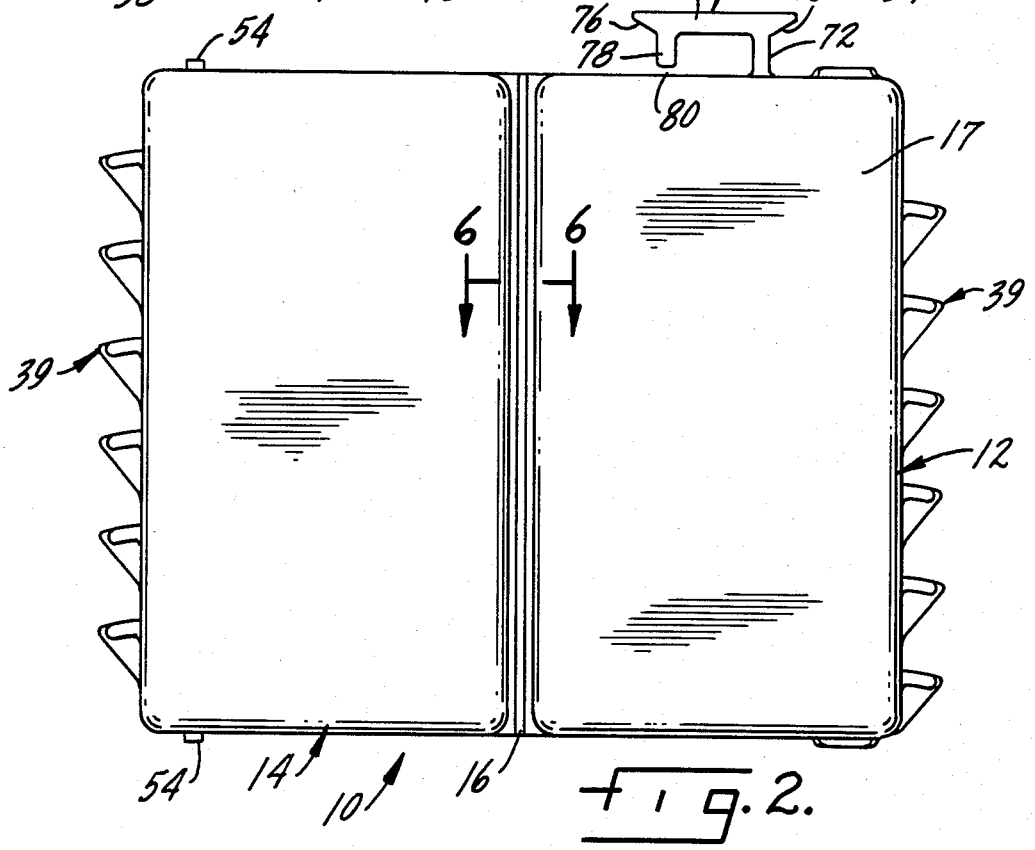
Fig. 2.

WIRE MARKER DISPENSER

SUMMARY OF THE INVENTION

This is concerned with a dispenser for dispensing wire marking tapes and more specifically is concerned with a compact dispenser which is easy to carry and of a size which will easily fit in the pocket or pouch of the user, such as an electrician.

A primary object is a dispenser for wire marking tape which holds a number of tape rolls and is constructed to provide for easy insertion of new rolls.

Another object is a dispenser which for a given size will hold and dispense a greater number of rolls.

Another object is a dispenser of the above type which is specifically constructed and arranged so that the tape can be more easily handled during tear off, etc.

Another object is a dispenser with a belt loop that is specifically constructed to fit in a track, for example, a terminal block track.

Another object is a dispenser of the above type which does not have to be opened to get at the tape.

Another object is a mounting for the tape spools in a dispenser of the above type constructed so that they will not fall off when the unit is open and held upside down.

Another object is a dispenser which is wholly contained and does not require that the units be modular with the difficulties attendant thereto.

Another object is a dispenser of the above type which greatly facilitates and simplifies tape dispensing.

Another object is a dispenser which has a living hinge.

Another object is a latch arrangement for a dispenser of the above type which securely holds the case together during use but provides for easy release when new rolls are to be inserted.

Other objects will appear from time to time in the ensuing specification and drawings.

BRIEF DESCRIPTION OF THE DRAWINGS

FIG. 1 is a side view of the dispenser in its open position;

FIG. 2 is a view showing the side opposite that of FIG. 1;

DESCRIPTION OF THE PREFERRED EMBODIMENT

Figure 3:
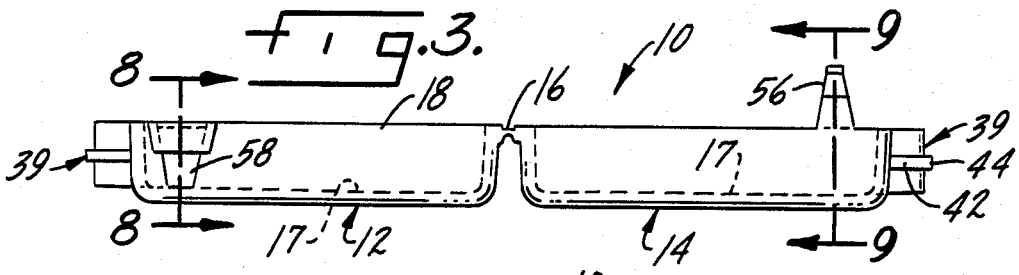
FIG. 3 is a bottom view of the dispenser of FIG. 1.
Figure 4:
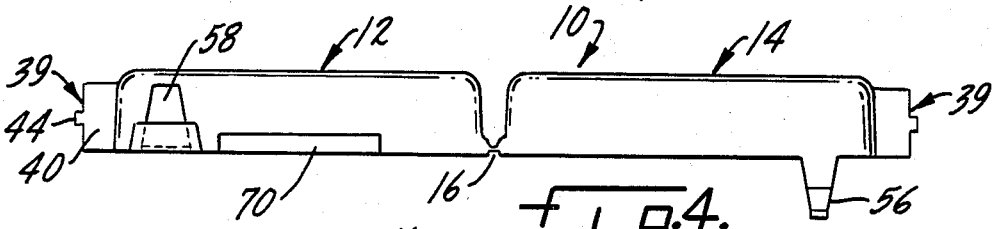
FIG. 4 is a top view of FIG. 1.

In FIGS. 1 through 5, a tape dispenser has been indicated generally at 10 and includes two halves or housings 12 and 14 which are hinged together by a living hinge 16. The two halves or housings 12 and 14 are more or less mirror images of each other to some degree although they differ in many respects. One may be considered the housing and the other the cover, or the whole thing may be looked at as a housing which is divided into two halves. The details of one will be explained and then the differences between the two will be set forth.

Each housing half has a generally flat side wall 17 with two lateral or end walls 18 and 20 and two longitudinal or side walls 22 and 24 which define a generally open interior to hold a plurality of tape spools.

The interior has risers or mountings for a plurality of spools which are shown as uprights or projections 26 in two rows 28 and 30, row 28 being nearer the outside wall 22 than the other. Each of the pins or mountings 26 is in the form of a generally cylindrical stub or projection which is integrally formed with the side wall 16 and has an annular bead 32 at or adjacent the outer end thereof with the sides removed at 34 so that the mounting takes on the character of opposed projections, each of which is flexible to a degree. Each of the tape spools has a central core or cylinder of cardboard or the like with the tape wrapped around the outside. The inside diameter of the central core is on the order of or slightly greater than the outside diameter of the mounting or stub 26 but less than the diameter of the end projection 32 so that when the tape spool is pushed onto the mounting, the sides thereof flex in slightly and then snap back out with the projection 32 overlapping the end of the spool so that the tape is releasably but firmly held in place. The projection 32 is slightly rounded both on top and bottom so that a tape spool can be mounted or removed by merely pushing it on or pulling it off. The result is that with the housing open and possibly turned upside down, the individual tape spools will not fall out but rather will be releasably held on the mountings or spindles. The peripheral extent of each of the prongs or tines of the mounting 26 should be such that sufficient flexibility is provided so that new spools may be easily inserted and the used-up center cores may be removed by hand.

As shown in FIG. 1, six tape mountings are provided in each housing half, in two rows of three each. Six openings 36 are provided in the outside wall, one for each tape spool so that the tape may be drawn out through the side of the unit. Three guide pins 38 are integrally molded in the housing and are staggered or offset relative to the tape mountings. It will be noted the mountings are lined up both laterally and longitudinally whereas the guide pins 38 are positioned between the two rows and are staggered relative to the mountings. The result is that tape from the three mountings in the near row 28 go directly through every other opening 36, whereas the tape from the far row 30 passes first around a guide pin 38 and then outwardly through every other opening. The tape is shown in phantom lines in FIG. 1, and it will be noted that the positioning of the guide pins 38 is such that the tape in its outward movement to its opening does not contact any of the rolls in the near row 28. Also, the tape has a slick side and an adhesive side and in the arrangement shown, the slick side contacts the guide pins 38.

Each of the openings 36 is laterally elongated and is subtended by a ramp or projection 39 which includes a ramp surface 40 and a supporting web 42 underneath it. The ramp surface 40 is wider than the tape and is formed at a slight radius so that it is slightly convex to the tape, it being understood that the direction of the tape is such that the adhesive side contacts the ramp surface 40. The web or support 42 underneath the ramp surface is smaller in cross section than the tape and extends slightly beyond the end of the ramp surface, as at 44. The tape itself is subdivided into uniform increments of length and is perforated so that it will tear off. The result of the ramp surface and web formation is that when the tape is pulled through an opening 36 until a perforated line is just beyond the end of the web projection 44, the flat adhesive side of the tape will be in full contact with the convex ramp surface 40 which is wider than the tape. And in the projection 44 where the web extends beyond the end of the ramp surface 40, the tape will be in contact therewith but its sides will overlap 44 because the tape is wider. Thus, when the user wants to pull out the next section of tape, there will be a free portion of the tape on each side of the extension 44 which the user can get hold of. Also, if the tape is pulled out far enough so that it is bent over the projection 44 and adheres to some of the web's outer surface, the side edges of the tape will extend beyond or overlap the web so, again, the user will be able to get hold of it.

It is important that the tape adhere to the convex ramp surface 40 and that it overlap the edges of the web 42 and extension 44. By this combination it is held in place and will not become loose and possibly stick to something else or go back through the opening 36. But, at the same time, it is positioned and constructed so that the operator can get hold of it the next time. By making the surface 40 slightly convex, the tape is bent around the surface during tear-off and therefore will be more or less firmly adhered to the surface until it is to be used again. This is far superior to having the surface straight or planar in that the tape will not reliably adhere to such a surface.

Figure 5:
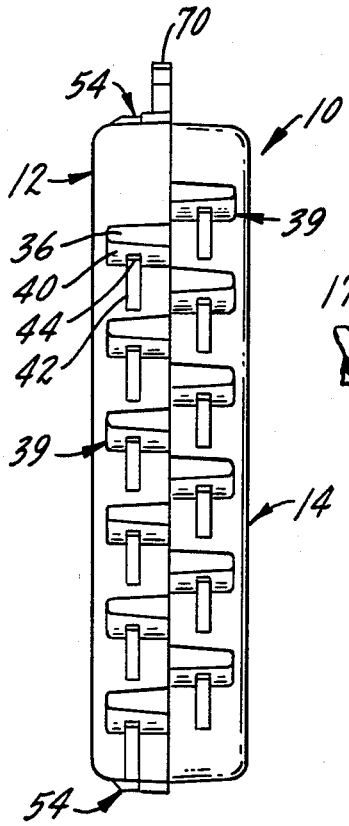
FIG. 5 is an end view of the unit closed.

It will be noted in FIG. 5 that the openings 36 for the tape in one housing half are offset from those in the other housing half so that when the unit is closed, the openings from each half are staggered or interfitted between the openings for the other half. Thus, some twelve distinct and separate openings are provided, six for each half. But the numbers, of course, could be different. The result is that in a unit of the type shown, each half carries a given number of tapes, in this case, six, and the combination gives twelve separate tapes with each having its distinct and separate opening.

Figure 6:
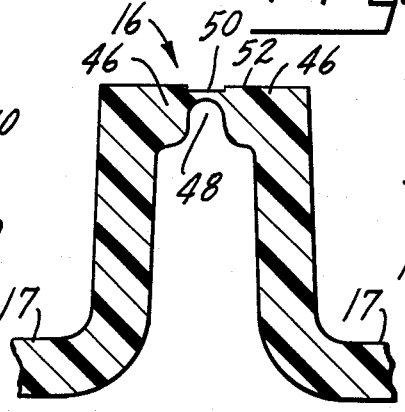
FIG. 6 is a section taken along line 6—6 of FIG. 2 on an enlarged scale.
Figure 7:
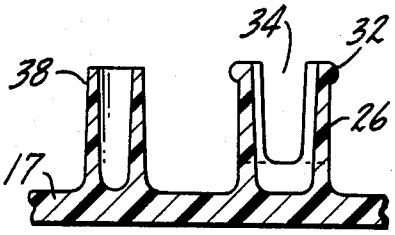
FIG. 7 is a section along line 7—7 of FIG. 1 on an enlarged scale.
Figure 8:
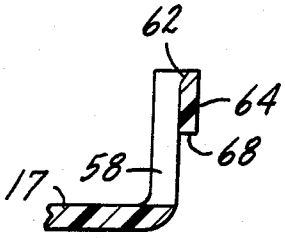
FIG. 8 is a section taken along line 8—8 of FIG. 3 on an enlarged scale.

The living hinge 16 between the two housing halves is shown in detail in FIG. 6 and it will be noted that each of the housing halves has a substantial section 46 extending into the hinge area with a major reduction 48 on the outside and a minor reduction 50 on the inside, the result of which is that the hinge itself is somewhat offset from the inner surfaces 52 so that when the two housing halves are brought together the hinge will loop outwardly somewhat and the two surfaces 52 will be in full and flush contact.

Figure 9:
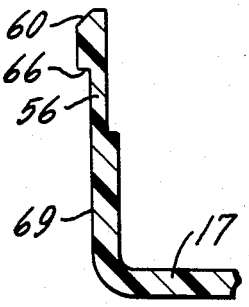
FIG. 9 is a section along line 9—9 of FIG. 3 on an enlarged scale.

Two latches 54 are provided between the two housing halves, one at the top and the other at the bottom which are adjacent the outside surfaces. Each latch includes a projection 56 on one and an opening 58 on the other. It will be noted in FIG. 9 that the projection has a forward ramp surface 60 which is designed to engage and flex by a ramp surface 62 on the catch 64 with the projection 56 being sufficiently flexible and of such a length that the forward projection will cam by the strap 64 and the rear abutment surface 66 will snap up and abut the rear catch surface 68 of the strap. The hook or projection 56 itself is tapered outwardly as shown in Fig. 3 and the opening 58 to receive it is correspondingly tapered inwardly as shown in FIGS. 1 and 3 with the two fully meshing when the two housing halves are closed and the projection snaps into the opening. The sides of the housing half 14 adjacent and including the projections 56 are sufficiently flexible such that the user can simultaneously press in with one hand on the sides of housing half 14 adjacent the projections 56 at the point 69 to release both latches at the same time.

Figure 10:
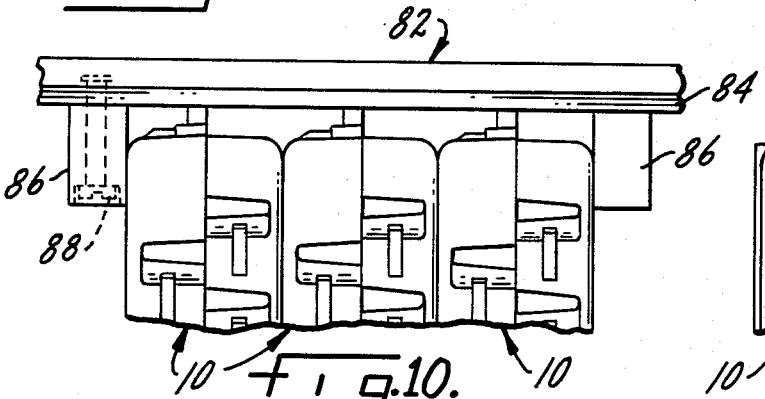
FIG. 10 is a front view of a number of units in inventory mounted on a terminal block track.

One end of one of the housing halves has a mounting bracket or belt loop 70 which includes an upright 72 integrally molded into the housing half with a crosspiece 74 that is disposed generally parallel to the side or end wall of the housing and has wings or angles 76 at each end and a dependent 78 at the other end which terminates short of the end of the housing to provide a gap 80 of a size such that the mounting can be used to go on the snap hook on a tool pouch. It will be noted that the crosspiece 74 is shaped at each end so that, as shown in FIG. 10, it will fit into a suitable track, for example, a terminal block track 82 with the wings 76 held therein by the track edges 84. As shown, a plurality of such dispensers or magazines could be put into a track and held at each end by brackets 86 which are held in place at screw 88. The hook arrangement 70 is shaped so that it can be put in sideways on the track and then turned until the wings 76 fit under the edges 84. With a plurality in such position, and compressed together, the fixed blocks 86 could be put in and secured at each end. The arrangement shown could be advantageously used for inventory and in fact for transportation purposes. A handle might be put on top of the track so that ten, fifteen or twenty of the dispensers could be in inventory and carried to the job site as a unit.

A variant form is shown in FIGS. 12 through 16. The housing includes one full half or side 90 which may be the same or similar to either half shown in the previous form with the other side being a simple cover 92 which may have internal ribs 94 for reinforcement. The mounting for the tape spools, the guides which give the offset feed of the two tapes in the remote row, the openings and ramp surfaces therefor as well as the mounting hook on the housing 90 may be as before.

The snap or hook 96, one at each end of the cover, may be varied somewhat in that the riser 96 is ramped on both sides as at 98 rather than just on the front side as in the previous form. In the arrangement shown in FIGS. 1–11 with the two housing halves closed and the hooks engaged, the user can depress the sides of the housing half 14 in the area adjacent to the extension, for example, at the point 69 and the flexibility of the sides will allow the hook or prong to depress sufficiently such that surface 66 will disengage from the surface 68. Since the cover in the form of FIGS. 12–15 does not provide this extent and the necessary flexibility therefor, the reverse edge of the risers 96 may also be ramped up, as at 98, so that disengagement can be manually effected.

The use, operation and function of the invention are as follows:

The unit provides a dispenser which may be used in either a six pack form as in FIGS. 12–16 or a twelve pack form as in FIGS. 1–11. In either form, the directional pins allow the tape rolls to be positioned in two generally parallel rows and the proper feeding of the tapes will allow the exit ports to be closely spaced. Thus, the overall volume of the unit can be greatly reduced as compared to having the tape rolls all in line. This is to say that the close spacing and the exit port arrangement eliminates the necessity to turn some or all of the tapes 90° as they go through the openings and therefore provide for a much closer spacing. In addition, as compared to units where the tape has to be turned 90° to be brought to an exit port, having all of the exit ports disposed parallel to each other and the tapes coming straight out has the advantage that the exit ports can be more closely spaced.

The exit port tear-off ramp and supporting rib also insure that the user can more easily grasp the end of the tape when it is to be used the next time. He doesn't have to pry it up with either his fingernail or a knife since the web underneath the exit ramp is thinner than the tape and extends slightly beyond it so that the exposed edge of the tape is always free on either side for the user to get hold of. The somewhat arcuate surface of the exit ramp or surface ensures a clean neat tear-off at the perforated line on the tape.

Figure 11:
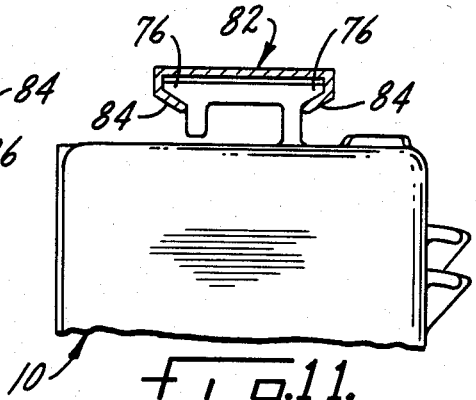
FIG. 11 is an end view of FIG. 10.
Figure 12:
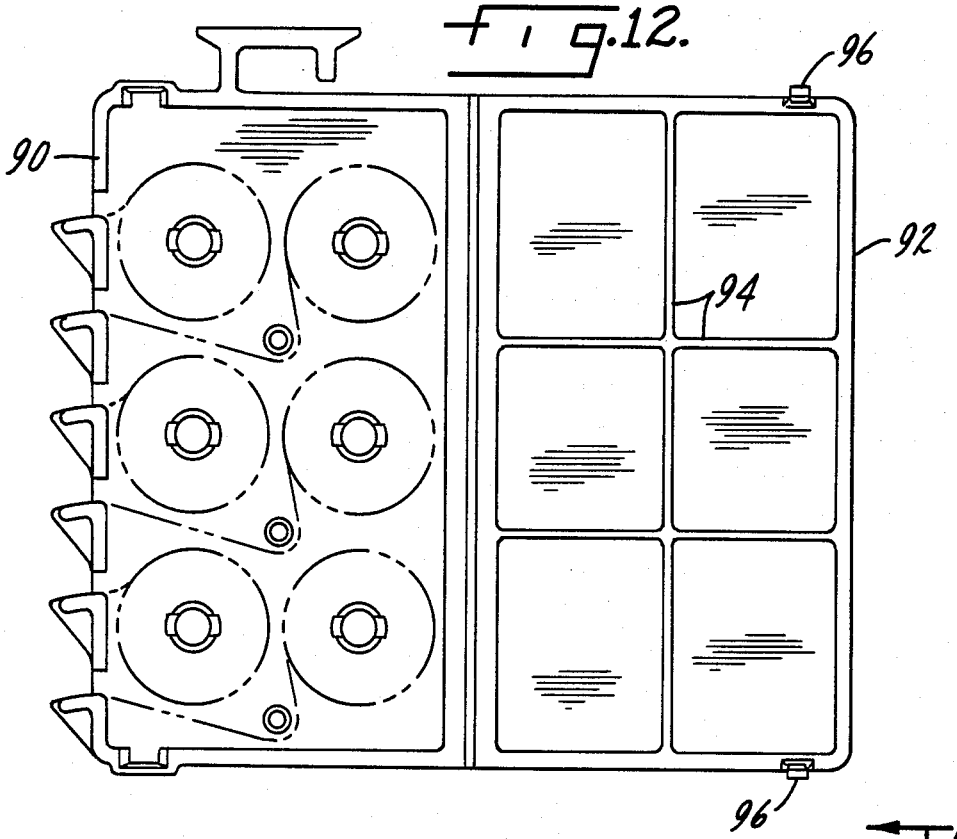
FIG. 12 is an open plan view of a modified form.
Figure 13:
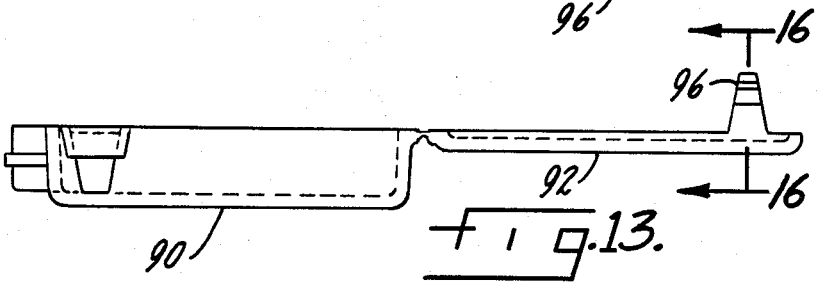
FIG. 13 is an end view of FIG. 12.
Figure 15:
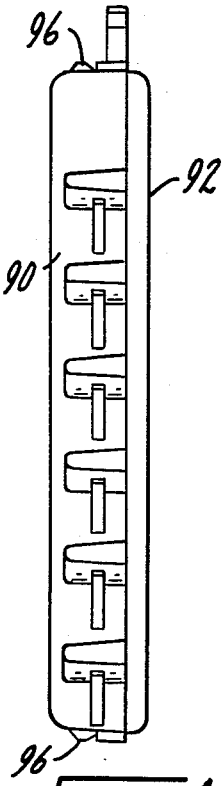
FIG. 15 is a side view of a unit closed.
Figure 14:
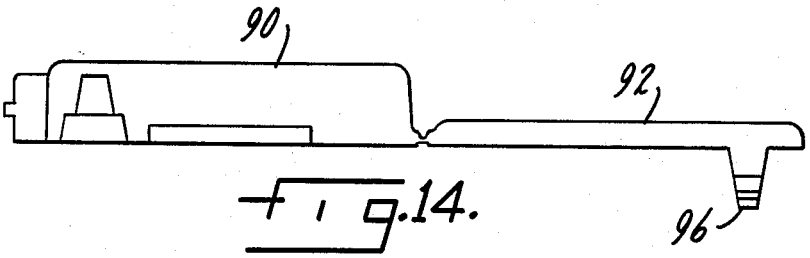
FIG. 14 is an end view, of the other end, of FIG. 12.
Figure 16:
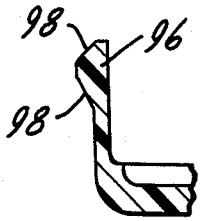
FIG. 16 is a section along line 16—16 of FIG. 13.

The belt loop arrangement is of particular advantage in mounting a plurality of such units, be they six pack or twelve pack, in a track as shown in FIGS. 10 and 11 which is for inventory and transportation in bulk. Any number can be positioned in a track depending upon what length is desired.

The mounting arrangement inside of the housing has the advantage that the spools are kept in place by a gripper unit since the mounting is divided into projecting fingers which provide a certain spring loading due to interference fit of the outstanding bead at the outer end thereof. In effect, the mounting gives a spring loaded gripper. Thus, the tape rolls will not fall out when the housing is open.

When a twelve pack unit, or whatever number is used, is provided so that there are openings in the opposite edges and each half is a magazine, the openings are staggered so that they do not interfere with each other which is to say that the openings in one half are opposite the tear-off and web structure on the other.

The unit has the distinct advantage that it may be molded all at one time in a flat position and is completed in one molding operation. There are no subsequent operations required to insert a separate part such as a cutter bar or stickers on the side or what-have-you. Further, the flat outer side of the housing, be it either form, may have all of the indicia, such as the name of the company, advertising, instructions, or what-have-you molded integrally therein. The case itself can be advantageously molded from polypropylene but it may be any suitable plastic.

While the preferred form and several variations have been shown and suggested, it should be understood that suitable additional modifications, changes, substitutions and alterations may be made without departing from the invention's fundamental theme.

I claim:

1. In a dispenser for marking tapes and the like, a generally flat housing with a cover defining therewith a generally open interior cavity for housing a Plurality of tape spools, a plurality of openings in one side of the housing through which the tape from the spools may be withdrawn for use, a plurality of mountings in the housing for the tape spools disposed in two rows, one nearer the openings than the other, and guides in the housing between the rows and offset relative to the row nearer the openings so that the tapes from the far row, when passed about one of the guides on its way to an opening, will not contact the tape rolls on the near row of mountings, the cover having an open interior with a plurality of side openings, mountings and offset guides corresponding to but reversed from those in the housing.

2. The structure of claim 1 further characterized in that the openings in the side of the cover are offset from those in the side of the housing so that the openings are staggered when the dispenser is closed.

3. In a dispenser for marking tape and the like, a housing having a generally open interior for enclosing at least one tape spool, a slot type opening in the side of the housing through which the tape from the spool is withdrawn for use, a ramp on the outside of the opening merging with one edge thereof and extending at an obtuse angle to the side of the housing, the ramp having a generally flat surface opposite the tape when it extends through the opening and of a width greater than the width of a tape, and a rib under the ramp merging into the side of the housing and of a width less than the width of the tape.

4. The structure of claim 3 further characterized in that the surface of the ramp is on a slight convex curve.

5. The structure of claim 3 further characterized in that the rib extends slightly beyond the end of the ramp surface.

6. The structure of claim 3 further characterized in that the rib is generally centrally located relative to the ramp surface.

7. In a dispenser for marking tapes and the like, a generally flat housing with two halves defining a generally open interior cavity for housing a plurality of tape spools, a plurality of mountings in the housing halves for the tape spools, and a plurality of openings in one side of each of the housing halves through which the tape from the spools may be withdrawn for use, the openings in the side of one of the housing halves being offset from those in the side of the other housing half so that the openings are staggered when the dispenser is closed.

8. The structure of claim 7 further characterized in that the mountings in each of the housing halves for the tape spools are disposed in two rows, one nearer the openings than the other, and further including guides in the housing between the rows and offset relative to the row nearer the openings so that the tape from the far row, when passed about one of the guides on its way to an opening, will not contact the tape rolls on the near row of mountings.

9. In a dispenser for marking tape and the like, a housing having a generally open interior for enclosing at least one tape spool, a slot type opening in the side of the housing through which the tape from the spool is withdrawn for use, and a ramp on the outside of the opening merging with one edge of the opening and extending at an obtuse angle to the side of the housing, the ramp having a slightly convexly curved surface opposite the tape when it extends through the opening terminating in an outer free edge so that the tape will slightly wrap around the convexly curved surface when it is torn off across the outer edge, and a rib under the ramp merging into the side of the housing and with a width slightly less than the width of the tape.

10. The structure of claim 9 characterized in that the rib extends slightly beyond the end of the ramp surface.

* * * * *